US008646716B2

(12) United States Patent
Baxter

(10) Patent No.: US 8,646,716 B2
(45) Date of Patent: Feb. 11, 2014

(54) CAROUSEL FOR FLEXIBLE PRODUCT

(75) Inventor: John Baxter, Stavanger (NO)

(73) Assignee: Subsea 7 Norway AS, Royneberg (NO)

( * ) Notice: Subject to any disclaimer, the term of this patent is extended or adjusted under 35 U.S.C. 154(b) by 676 days.

(21) Appl. No.: 12/633,015

(22) Filed: Dec. 8, 2009

(65) Prior Publication Data

US 2010/0147988 A1 Jun. 17, 2010

(30) Foreign Application Priority Data

Dec. 11, 2008 (GB) ..... 0822611.0

(51) Int. Cl.
*B21C 47/00* (2006.01)

(52) U.S. Cl.
USPC ..... 242/360

(58) Field of Classification Search
USPC ..... 242/360–363
See application file for complete search history.

(56) References Cited

U.S. PATENT DOCUMENTS

| | | | | |
|---|---|---|---|---|
| 5,013,186 | A | 5/1991 | Kakizaki | |
| 5,823,456 | A * | 10/1998 | Bordignon et al. | 242/362 |
| 5,836,536 | A | 11/1998 | Bodden | |
| 6,237,868 | B1 * | 5/2001 | Shore et al. | 242/360 |
| 7,178,484 | B2 * | 2/2007 | Kleinsasser | 119/505 |
| 8,087,604 | B2 * | 1/2012 | Palfreman et al. | 242/362.2 |
| 2008/0170911 | A1 * | 7/2008 | Snowdon et al. | 405/166 |

FOREIGN PATENT DOCUMENTS

| | | | |
|---|---|---|---|
| WO | WO00/06868 | A1 | 2/2000 |
| WO | WO2005/010316 | A2 | 3/2005 |
| WO | WO2010/018396 | | 2/2010 |

* cited by examiner

*Primary Examiner* — William E Dondero
(74) *Attorney, Agent, or Firm* — Levy & Grandinetti

(57) ABSTRACT

A carousel for the storage of flexible product, and a method of loading flexible product thereon, wherein said carousel comprises an open drum mounted to rotate around a vertical axis, an elevatable floor, preferably internal to said drum and lifting means for lifting and lowering said elevatable floor. Said lifting means possibly being located between a base of said carousel and said elevatable floor. Said carousel may be of the type designed for location under deck on a marine pipelaying vessel, said flexible product being flexible conduit for the transport of hydrocarbons.

14 Claims, 4 Drawing Sheets

CAROUSEL FOR FLEXIBLE PRODUCT

This invention is concerned with storage of flexible pipe, or other flexible product, and in particular to carousels used for storage and installation of such flexible pipe.

Carousels are a known means in the offshore industry for the storage, transportation and installation of flexible product (such as flexible pipe, umbilicals etc.). As their name suggests, they comprise a base, an outer wall and a hub and are such that the flexible product is spooled around the hub. To aid spooling some or all of the carousel will be driven by motors to turn around the hub's axis. Carousels can be made to be used vertically or horizontally, or at any angle therebetween, and may comprise means to move it between any of these configurations.

One problem with carousels, and in particular horizontal under-deck carousels, that the inventors have identified, is that during loading of the flexible product there is a tendency for the product to twist and for a torque to build up on it. This torque has in many instances resulted in damage to the product. It is now understood by the inventors that this tendency to twist is caused by the double bending of the product caused by the difference in height between the loading hatch on the main deck and the carousel floor.

It is an aim of the present invention to address the above-mentioned problem.

In a first aspect of the invention there is provided a carousel for the storage of flexible product wherein said carousel comprises an elevatable floor and lifting means for lifting and lowering said elevatable floor.

Said carousel may be designed to be used in a horizontal configuration and comprise a base, outer cylindrical wall and central hub. Said elevatable floor may be said base, or may be a further floor. Said lifting means may be located between said base and said elevatable floor. Alternatively said lifting means may be comprised below said base.

Said carousel may be rotatably mounted so that it is rotatable around the hub's axis.

Said lifting means may comprise airbags, the level of the floor dependent on the pressure inside said airbags. The term "airbag" is used in its generic sense and is not to be taken to limit the pressurising fluid used to only air. Instead it should be understood that any suitable fluid may be used. Alternatively the lifting means may comprise hydraulic or mechanical jacking means.

There may be provided a controller for controlling said lifting means, operable to lower the floor of the carousel as product is loaded thereto in such a way as to maintain the product entry angle within predetermined limits. It may be further operable to maintain the product entry angle as substantially constant as possible. The product entry angle should be taken to be the angle of the flexible product as it enters the carousel, with reference to the horizontal. Said controller could, of course, be physically remote from the carousel itself.

Said carousel may be of the type designed for location under deck on a marine pipelaying vessel. Said flexible product may be flexible conduit for the transport of hydrocarbons.

In a further aspect of the invention there is provided a method of loading flexible product onto a horizontal carousel, said method comprising:

raising the floor of the carousel to a predetermined position;

lowering the flexible product onto said floor, from above, while said carousel is turning; and maintaining the product entry angle within predetermined limits, by lowering the floor of the carousel as the product is loaded.

Said predetermined position may be the floor's uppermost position.

Said floor may be lowered stepwise or substantially continuously during loading.

Said product entry angle may be kept as substantially constant as possible during loading.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
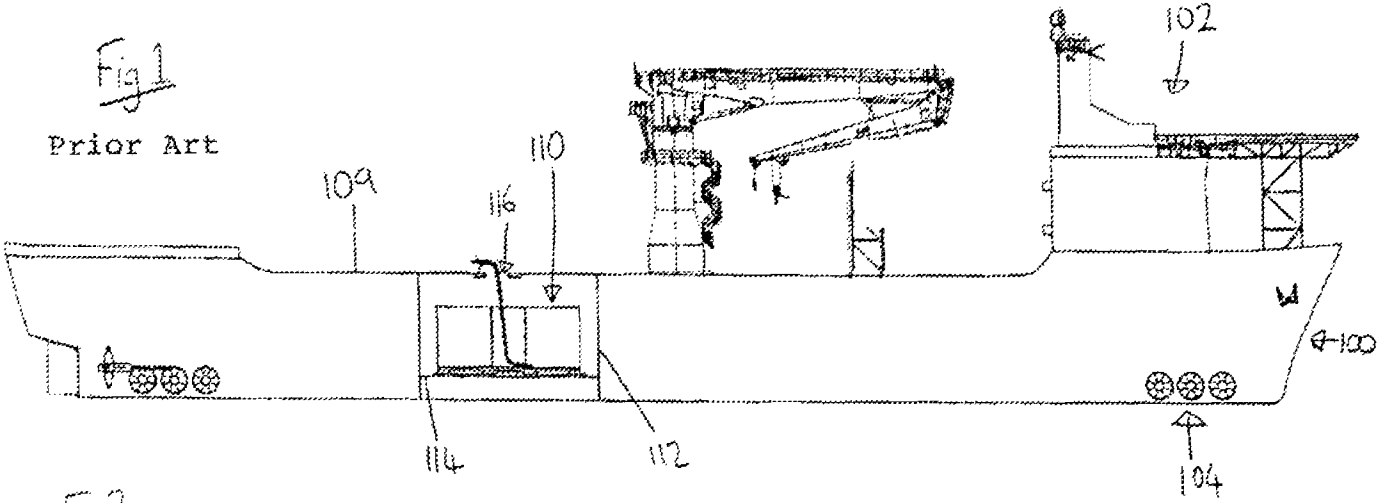
Fig 1 Prior Art
FIG. 1 shows a partially cut-away side view of an offshore service vessel with a carousel.
Figure 2:
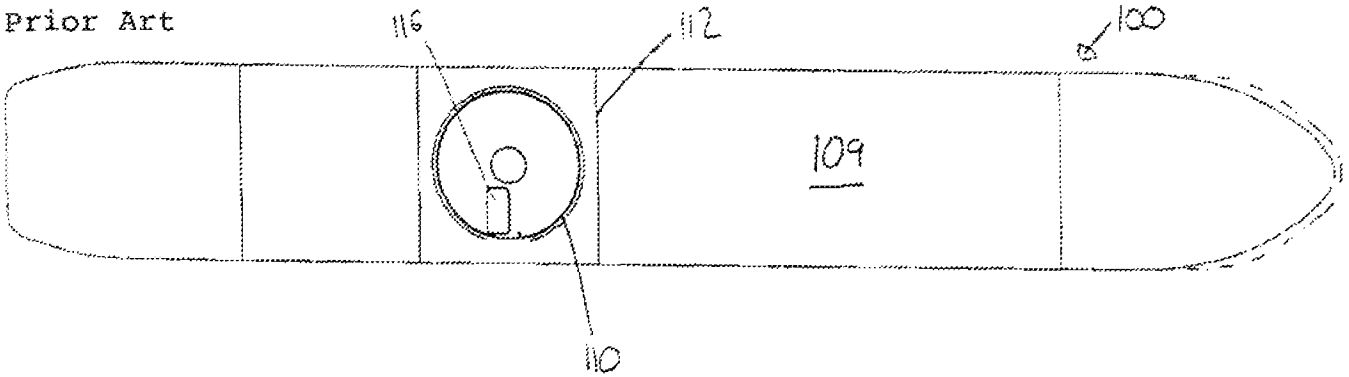
Fig 2 Prior Art
FIG. 2 shows a plan view of the vessel of FIG. 1.

Referring to FIGS. 1 and 2, an offshore service vessel comprises a hull 100 with a superstructure 102, located forward of a larger working area. The vessel has various thrusters 104 to provide dynamic positioning (position holding) during operations of the vessel, for example pipe laying and mooring chain installation.

The vessel also has a deck 109. For the storage, transportation and installation of flexible product (such as flexible pipe, umbilicals etc.), a carousel 110 is provided, located below the level of the deck 109, in a compartment 112. The compartment 112 has a floor 114 and its ceiling is the deck 109. A loading hatch 116 in the deck 109 provides access to the compartment 112.

Further carousels 110 and storage space (not shown) may also be provided, which can additionally be used for flexible product, or other equipment.

Figure 3:
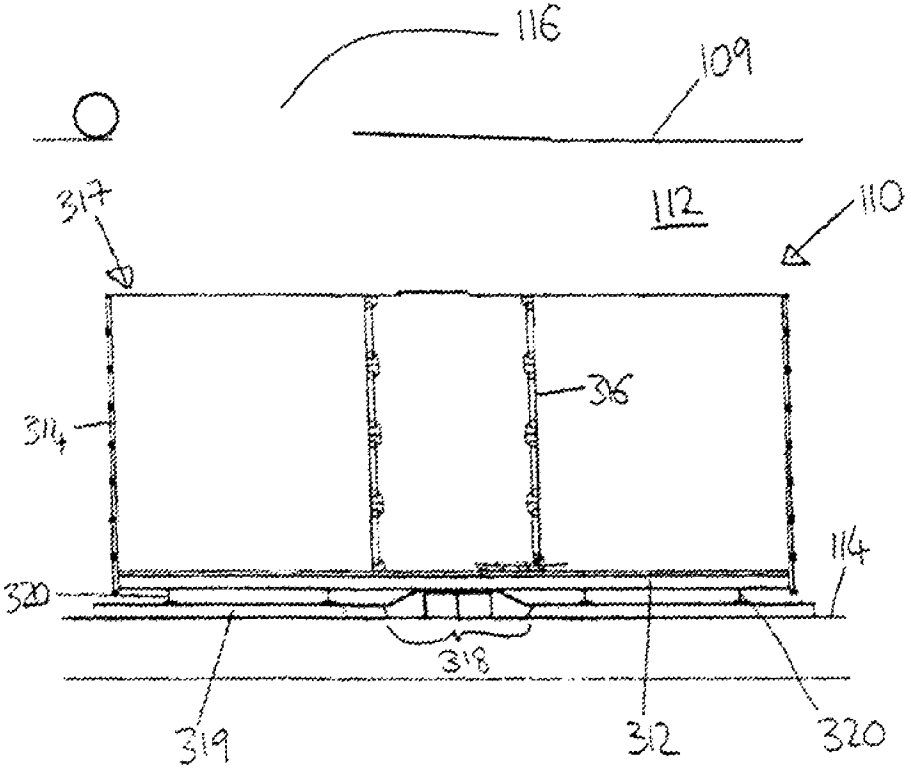
Fig. 3 Prior Art
FIG. 3 shows an enlarged view of a compartment of the FIG. 1 vessel, showing the carousel in more detail.

FIG. 3 shows a prior art carousel 110 in greater detail. It comprises a base 312, an outer cylindrical wall 314, and an inner cylindrical wall, which forms a hub 316 of the carousel 110. The outer cylindrical wall 314 is provided at the radially outermost extent of the base 312. The base 312, the outer cylindrical wall 314 and the hub 316 together define a body 317 of the carousel 110, in which flexible pipe etc. can be stored.

The base 312 is located on a support plate 319, which includes an upwardly-extending hub support 318 at its centre, which also corresponds with the centre of the base 312.

The hub support 318 has an upper bearing surface, on which the base 312 is directly mounted. Also between the base 312 and the support plate 319 various bearings 320 (e.g. slide bearings or roller bearings) are located radially outwards of the hub support 318. Hence, the body 317 of the carousel 110 is rotatably mounted on the support plate 319. The support plate 319 is, in turn, located on the floor 114 of the compartment 112.

Figure 4:
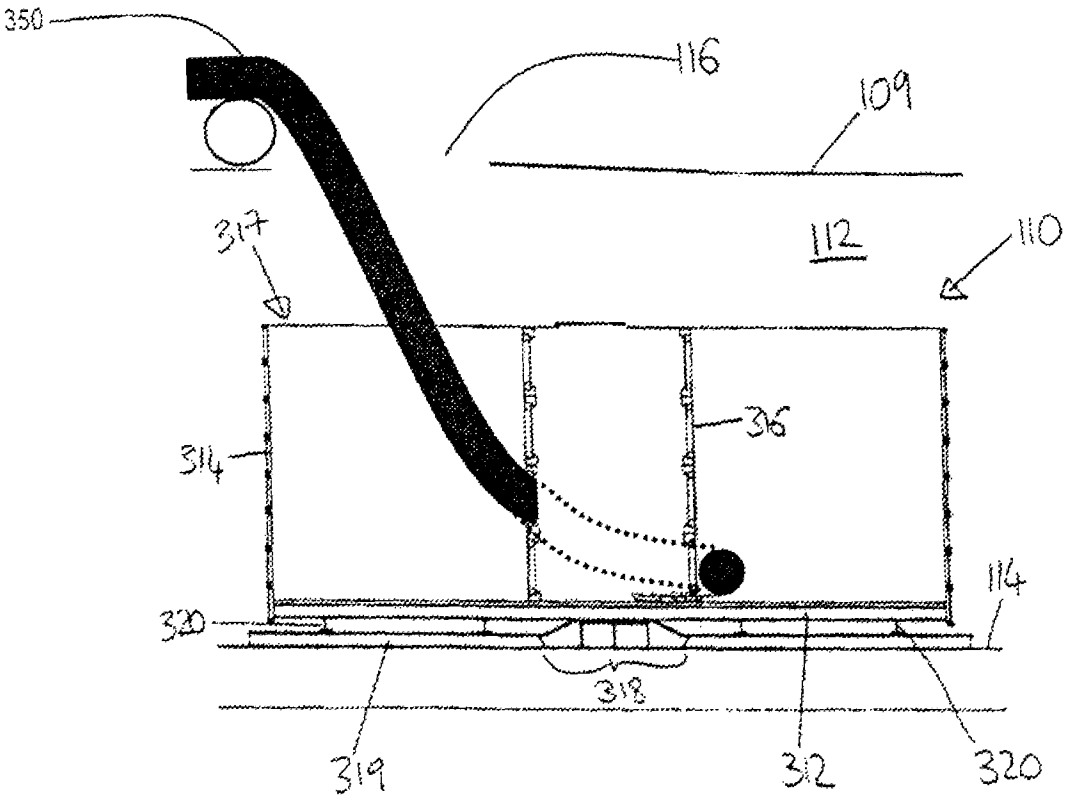
Fig. 4 Prior Art
FIG. 4 shows flexible product being loaded on a carousel as depicted in FIG. 3.

FIG. 4 illustrates the main problem with prior art carousels. It shows flexible product 350 being loaded onto the convention carousel 110. Due to the significant distance (in the region of 8 to 10 meters) between the deck 109 and the carousel base 312, the flexible product is caused to bend in two directions in the region around the hub 316. As can be seen, the flexible product 350 in this region sags due to its own weight, causing bending in one direction, while at the same time it is being wound around the hub 316, thereby also being bent in another direction. Consequently, the flexible product 350 is twisted, causing a torque build up to which it is susceptible, so much so that it is often damaged in this way.

Figure 5:
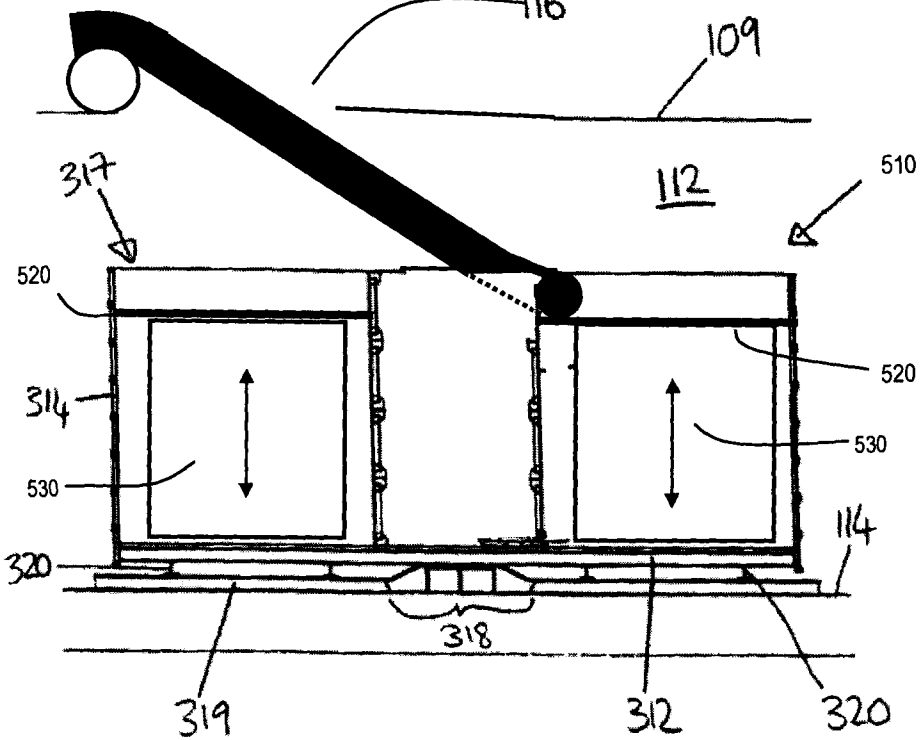
FIG. 5 shows flexible product being loaded onto a carousel in accordance with an embodiment of the invention.

FIG. 5 shows a type of carousel design 510 which aims to address the above problem. It comprises, in addition to the features of the conventional carousel 110, an elevating floor 520 and airbags 530 for lifting and lowering the elevated floor. Airbags 530 are shown here as a particularly suitable means for lifting and lowering the floor 520, however the skilled person will realise that any other lifting/jacking means could be used instead, whether they be pneumatic, hydraulic, mechanical or any combination thereof.

Before beginning loading of the flexible product 350, the elevated floor 520 is raised to its highest position, thus greatly decreasing the distance between the carousel floor 520 and deck 109. This results in a low entry angle for the flexible product 350 as it is loaded onto the carousel. This low entry angle is maintained as the carousel is filled by lowering the floor 520 accordingly. Ideally a controller will be provided to control the inflation and/or deflation of the airbags 530 (or other sorts of lifting means in an appropriate manner), so as to maintain the entry angle either at or near a constant angle, or at least between predetermined limits at which it is known that no damage to the product 350 will result. The floor 520 could be controlled manually, however. When the loading is completed the floor 520 can be parked at the bottom of carousel 510, with airbags 530 empty.

The above examples are for illustration only and modifications and improvements may be incorporated without departing from the spirit and scope of the invention. For example, the lifting means for lifting the elevated floor may differ, as may the type of carousel or the type of flexible product depicted.

The invention claimed is:

1. A carousel for mounting in a marine pipelaying ship for the storage of flexible pipeline for subsea transport of hydrocarbons, wherein said carousel comprises:

an open drum mounted to rotate around a vertical axis, an elevatable floor and a lifting mechanism for lifting and lowering said elevatable floor, said carousel being under deck on said marine pipelaying ship; and a controller for controlling said lifting mechanism, said controller being operable to lower the floor of the carousel as pipeline is loaded thereto from above in such a way as to maintain a pipeline entry angle within predetermined limits.

2. A carousel as claimed in claim 1 operable to be used in a horizontal configuration, the carousel further comprising a base, an outer cylindrical wall and a central hub.

3. A carousel as claimed in claim 2 wherein said elevatable floor is a floor other than said base and said lifting mechanism is located between said base and said elevatable floor.

4. A carousel as claimed in claim 1 wherein said lifting mechanism comprises airbags, such that the level of the floor is dependent on the pressure inside said airbags.

5. A carousel as claimed in claim 1 wherein said controller is further operable to maintain the pipeline entry angle substantially constant.

6. A method of loading flexible pipeline for subsea transport of hydrocarbons onto a horizontal carousel mounted in a marine pipelaying ship, said method comprising:

raising a floor of the carousel to a predetermined position;

lowering the flexible pipeline onto said floor, from above, while said carousel is turning; and maintaining a pipeline entry angle within predetermined limits, by lowering the floor of the carousel as the pipeline is loaded thereon.

7. A method as claimed in claim 6 wherein said predetermined position is the floor's uppermost position.

8. A method as claimed in claim 6 wherein said floor is lowered stepwise during loading.

9. A method as claimed in claim 6 wherein said floor is lowered substantially continuously during loading.

10. A method as claimed in claim 6 wherein said pipeline entry angle is kept substantially constant during loading.

11. A method as claimed in claim 6, wherein said carousel is designed for location under deck on the marine pipelaying vessel.

12. A marine pipelaying ship comprising a carousel for the storage of flexible pipeline for subsea transport of hydrocarbons, said carousel being under deck on said marine pipelaying ship, wherein said carousel comprises an open drum mounted to rotate around a vertical axis, an elevatable floor internal to said drum and a lifting mechanism for lifting and lowering said elevatable floor, said lifting mechanism being located between a base of said carousel and said elevatable floor.

13. A marine pipelaying ship as claimed in claim 12 wherein said lifting mechanism comprises airbags, the level of the floor being dependent on the pressure inside said airbags.

14. A marine pipelaying ship as claimed in claim 12 wherein the carousel comprises a controller for controlling said lifting mechanism, said controller being operable to lower the floor of the carousel as product is loaded thereto in such a way as to maintain a pipeline entry angle substantially constant.

* * * * *